US007321341B2

(12) United States Patent
Lee et al.

(10) Patent No.: US 7,321,341 B2
(45) Date of Patent: Jan. 22, 2008

(54) COMPACT BROADBAND ANTENNA WITH CONSTANT RADIATION PATTERN

(75) Inventors: Yoonjae Lee, Fairfax, VA (US); Suman Ganguly, Falls Church, VA (US)

(73) Assignee: Center for Remote Sensing, Inc., Fairfax, VA (US)

( * ) Notice: Subject to any disclaimer, the term of this patent is extended or adjusted under 35 U.S.C. 154(b) by 0 days.

(21) Appl. No.: 11/453,566

(22) Filed: Jun. 15, 2006

(65) Prior Publication Data

US 2006/0290586 A1 Dec. 28, 2006

Related U.S. Application Data

(63) Continuation of application No. 11/165,613, filed on Jun. 23, 2005, now abandoned.

(51) Int. Cl.
*H01Q 21/00* (2006.01)

(52) U.S. Cl. ..... 343/893; 343/810

(58) Field of Classification Search ..... 343/893, 343/810, 900, 773, 774

See application file for complete search history.

(56) References Cited

U.S. PATENT DOCUMENTS 5,990,845 A * 11/1999 Sharp et al. ..... 343/846
6,198,454 B1 * 3/2001 Sharp et al. ..... 343/773

* cited by examiner

*Primary Examiner*—Hoanganh Le
(74) *Attorney, Agent, or Firm*—Hoffman, Wasson & Gitler, PC

(57) ABSTRACT

An antenna having multiple antenna elements of unequal lengths, form in a conical shape. The longest antenna element has a trap in a specific location of the antenna element. Multiple traps can be used for extended coverage depending upon the frequency band. The antenna elements are connected together through a transversal-wire ring and a feed transmission line is attached to it. The antenna occupies minimal footprint in the horizontal direction and maintains a low VSWR and a uniform beam pattern over a wide frequency band, more than 1:20. The antenna has a constant radiation pattern over a 1:6 bandwidth and the pattern bandwidth may be increased using more antenna elements and traps. The elevation and azimuth patterns show a consistent characteristic from 100 MHz to 600 MHz.

14 Claims, 8 Drawing Sheets

Upper Wire # (Lower Wire #)

COMPACT BROADBAND ANTENNA WITH CONSTANT RADIATION PATTERN

RELATED PATENT APPLICATION

This patent stems from a continuation application of U.S. patent application Ser. No. 11/165,613, and filing date of Jun. 23, 2005 now abandoned, entitled COMPACT BROADBAND ANTENNA WITH CONSTANT RADIATION PATTERN by inventors, YOONJAE LEE, and SUMAN GANGULY. The benefit of the earlier filing date of the parent patent application is claimed for common subject matter pursuant to 35 U.S.C. § 120.

BACKGROUND OF THE INVENTION

This patent relates to broadband antennas, and more particularly a broadband antenna that has constant gain and VSWR characteristics over a 1:20 bandwidth.

DESCRIPTION OF THE RELEVANT ART

The invention relates to compact broadband antennas providing uniform beam pattern over a wide frequency range. There are various antenna structures available for broadband operation. Conventional broadband antennas such as discone, conical spiral, biconical antenna, bowtie, etc., exhibit desirable matching characteristics over a wide frequency range, for example, 1:10 frequency ratio. However, those conventional elements have drawbacks. First, the conventional broadband structures occupy fairly large areas in transversal direction. For example, the diameter of a discone antenna is comparable to its height. This is because the geometry must scale accordingly with the operating frequency in order to achieve a broadband characteristic over a large bandwidth The second drawback is the radiation patterns of such antennas change as the operating frequency changes. The antenna pattern of a bowtie antenna resembles that of a dipole. At low frequencies, generally when the antenna length is less than a wavelength of the operating frequency, the antenna exhibits a single lobe in the direction parallel to the antenna; however, if the wavelength of the operating frequency is shorter than the length of the antenna, multiple lobes are created. This can be a significant problem in various applications including broadband array, direction finding (DF), etc.

Although there have been several multiband antennas using multiple wire elements, the prior art on broadband antennas generally relied on large traveling wave type antennas or smaller bow tie type of antennas. The bow tie antennas can provide large instantaneous bandwidths but generally have large lateral dimension to cover large bandwidths. The present innovation is based on the fat-dipole and bow tie type approaches, where the lateral dimensions have been reduced and optimized for efficient bandwidth and smooth radiation pattern over the entire bandwidth. This is important for many applications, such as DF.

SUMMARY OF THE INVENTION

A general object of the invention is a broadband antenna with a constant gain and constant voltage-standing-wave ratio over a bandwidth having better than 1:10 frequency ratio.

According to the present invention, as embodied and broadly described herein, a broadband antenna with a constant radiation pattern is provided. The broadband antenna comprises a first plurality of antenna elements, a second plurality of antenna elements, a first transversal-wire ring, a second transversal-wire ring, and an insulator.

Each antenna element in the first plurality of antenna elements is rigid and has a different length from other antenna elements in the first plurality of antenna elements. A first longest-antenna element has a length longer than other antenna elements in the first plurality of antenna elements. The first longest-antenna element has a first trap at a specific location of the first longest-antenna element in the first plurality of antenna elements. Common ends of the first plurality of antenna elements are shaped to a first common point. The first transversal-wire ring connects the common end of each antenna element of the first plurality of antenna elements, to form a first conical shape of a cylindrical antenna.

Each antenna element in the second plurality of antenna elements is rigid and has a different length from other antenna elements in the second plurality of antenna elements. Preferably, the length of each antenna element in the second plurality of antenna elements is the same as the length of each antenna element in the first plurality of antenna elements. A second longest-antenna element has a length longer than other antenna elements in the second plurality of antenna elements. The second longest-antenna element has a second trap at a specific location of the second longest-antenna element in the second plurality of antenna elements. The second transversal-wire ring connects a common end of each antenna element of the second plurality of antenna elements, to form a second conical shape of a cylindrical antenna.

The insulator rigidly connects the second common point of the second plurality of antenna elements with the first common point of the first plurality of antenna elements. Aa rigid dipole is formed which has the second conical shape of the cylindrical antenna, at the second common point, opposite to the first conical shape of the cylindrical antenna, at the first common point.

Additional objects and advantages of the invention are set forth in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

DETAILED DESCRIPTION OF THE PREFERRED EMBODIMENTS

Figure 1:
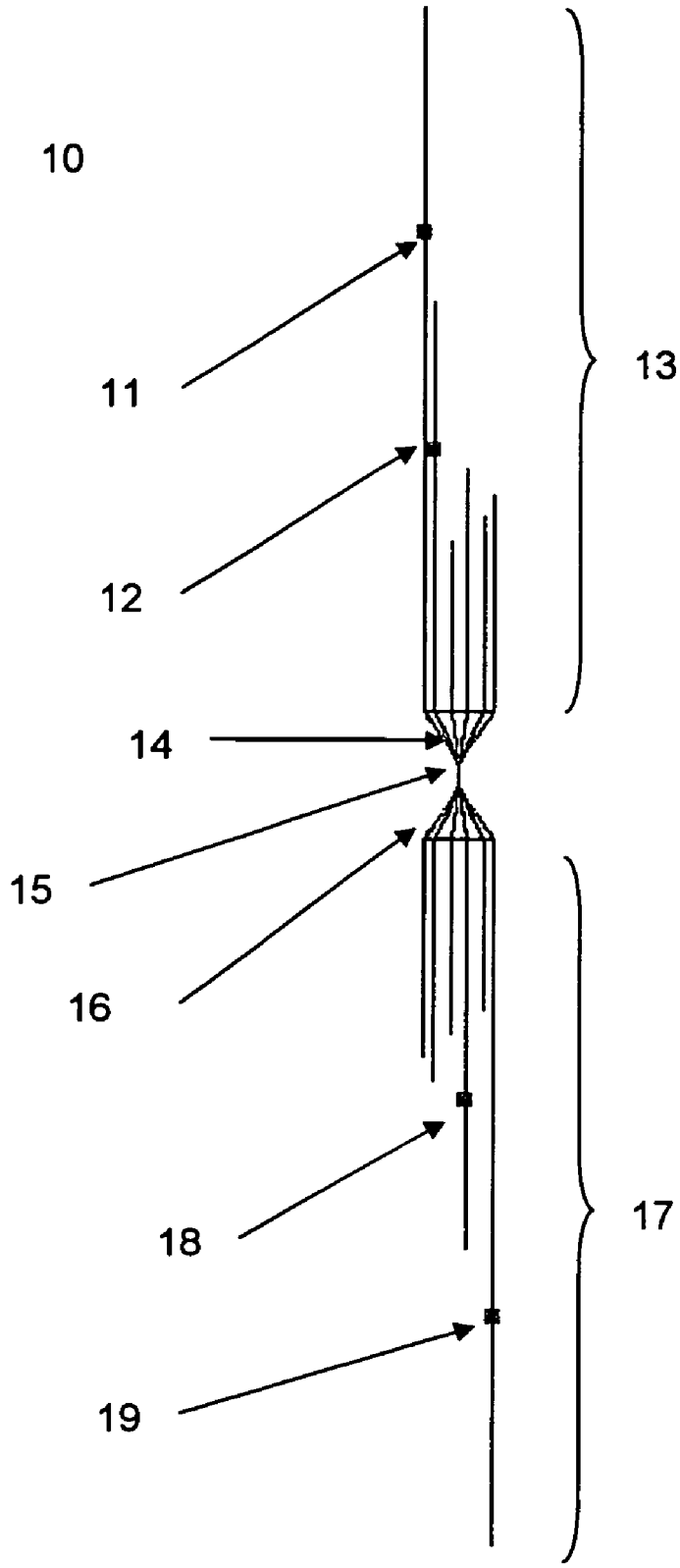
FIG. 1 illustrates the compact broadband antenna.

Reference now is made in detail to the present preferred embodiments of the invention, examples of which are illustrated in the accompanying drawings, wherein like reference numerals indicate like elements throughout the several views.

Figure 2:
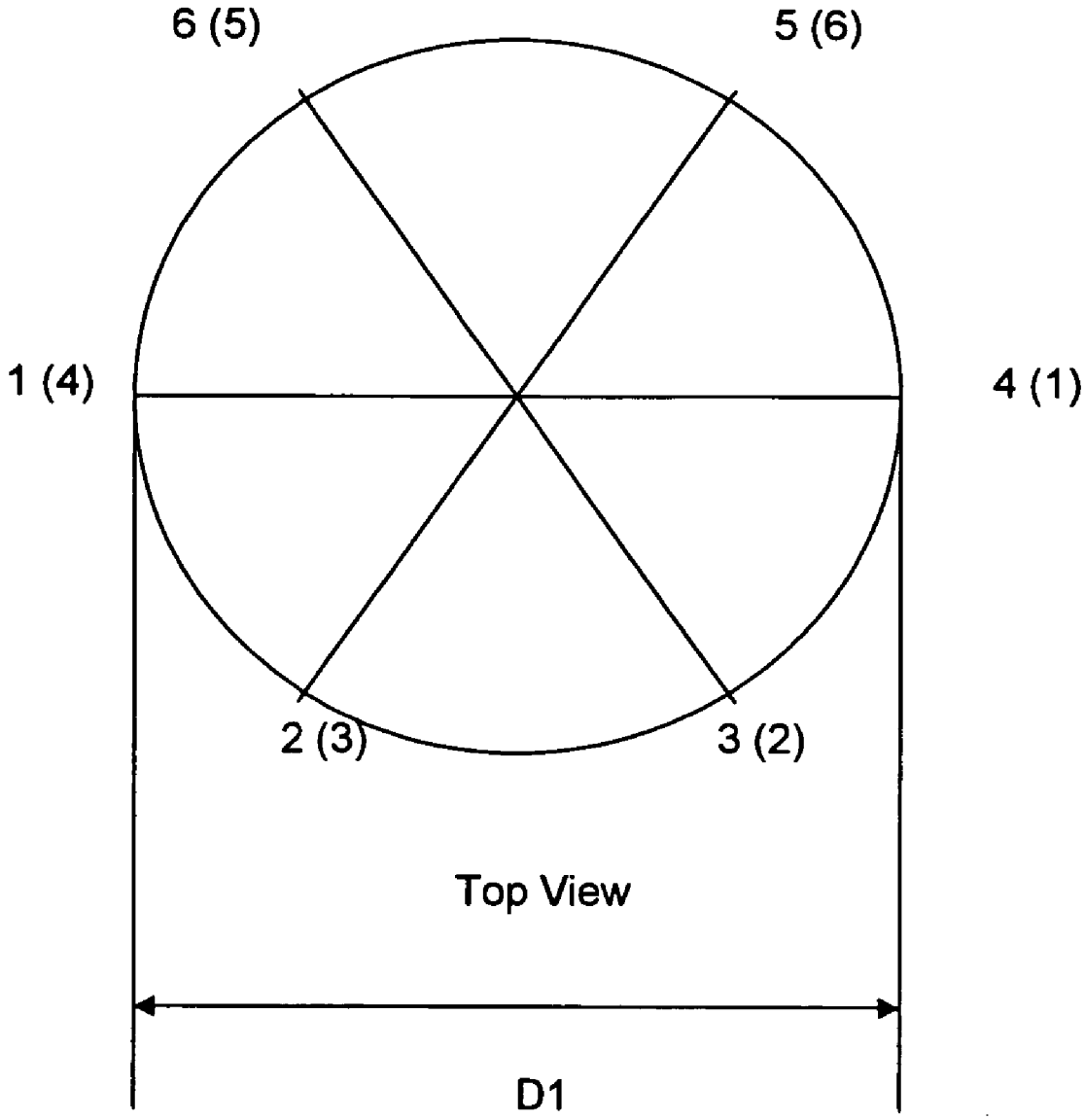
FIG. 2 illustrates a top view placement of antenna elements for the compact broadband antenna.

As illustratively shown in FIG. 1, the present invention provides a unique broadband antenna 10 with a constant radiation pattern. The broadband antenna 10 has a first plurality 13 of antenna elements, a second plurality 17 of antenna elements, first ring means, second ring means, and a feeding point 15. The feeding point 15 may include an insulator. FIG. 2 shows positioning of common antenna elements in the first plurality of antenna elements 13 and the second plurality of antenna elements 17.

Each antenna element in the first plurality 13 of antenna elements is rigid and has a different length from other antenna elements in the first plurality of antenna elements. The first plurality 13 of antenna elements typically includes multiple vertical wires of unequal lengths, as shown in FIG. 1. A first longest-antenna element in the first plurality 13 of antenna elements has a length longer than other antenna elements in the first plurality 13 of antenna elements. The first longest-antenna element has a first trap 11 at a specific location of the first longest-antenna element in the first plurality 13 of antenna elements. The first trap 11 normally is an inline filter, having resistance (R), inductance (L) and capacitance (C) or equivalent, as is well-known in the art. Multiple traps 11, 12 can be used for extended coverage depending upon the frequency band. The multiple traps may be in the same antenna element or in different antenna elements, as shown in FIG. 1.

Figure 3:
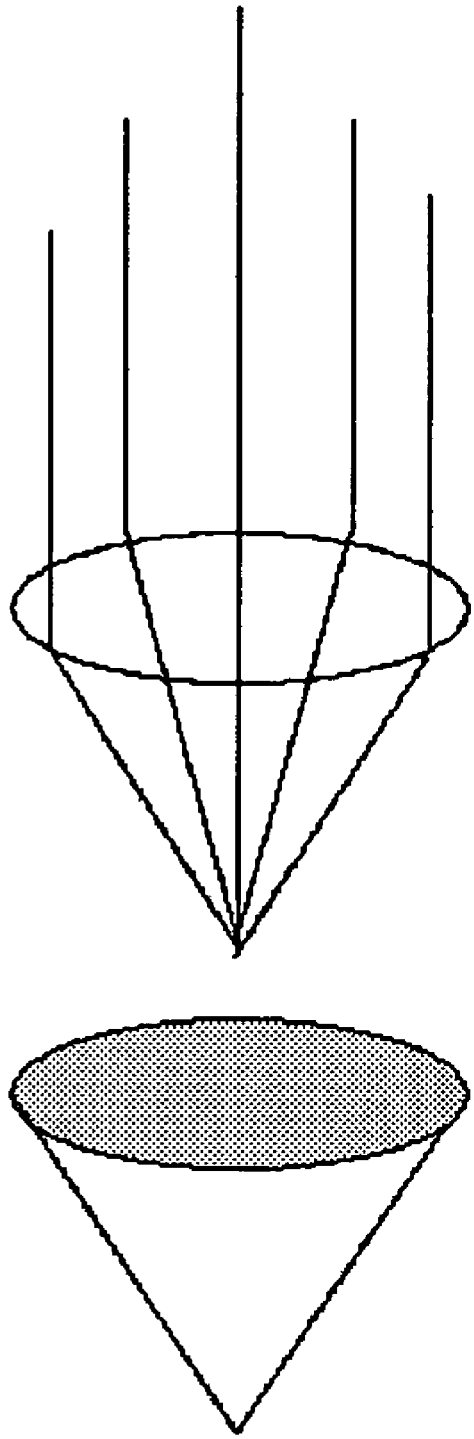
FIG. 3 shows the conical section, made from wires or solid metal sheet.

Common ends of the first plurality of antenna elements are shaped to a first common point 14. First ring means connects a common end of each antenna element of the first plurality 13 of antenna elements, to form a first conical shape of a cylindrical antenna, with common ends of the first plurality of antenna elements shaped to a first common point 14. The first ring means may be embodied, as shown in FIG. 3, as a circular wire, i.e., a first support such as a transversal-wire ring, or as a conical section made from a sheet of metal, such as copper. The vertical first plurality 13 of antenna elements is connected together through the transversal-wire ring at the bottom and a feed transmission line is attached to it. The antenna occupies minimal footprint in the horizontal direction and maintains a low VSWR and a uniform beam pattern over a wide frequency band, typically more than 1:20. The sample design shown in FIG. 1 achieves a constant radiation pattern over a 1:6 bandwidth and the pattern bandwidth may be increased using more wires and traps. The dimensions of the antenna shown in FIG. 1 are: 1 meter length, and 6 cm diameter. The elevation and azimuth patterns have a consistent characteristic from 100 MHz to 600 MHz.

Each antenna element in the second plurality 17 of antenna elements is rigid and has a different length from other antenna elements in the second plurality 17 of antenna elements. The second plurality 17 of antenna elements typically includes multiple vertical wires of unequal lengths, as shown in FIG. 1. A second longest-antenna element in the second plurality 17 of antenna elements has a length longer than other antenna elements in the second plurality of antenna elements. The second longest-antenna element has a second trap 19 at a specific location of the second longest-antenna element in the second plurality of antenna elements. The second trap 19 normally is an inline filter, having R-L-C or equivalent, as is well-known in the art. Multiple traps 18, 19 can be used for extended coverage depending upon the frequency band.

Second ring means connects a common end of each antenna element of the second plurality 17 of antenna elements, to form a second conical shape of a cylindrical antenna. The second ring means may be embodied, as shown in FIG. 3, as a circular wire, i.e., a second support such as a transversal-wire ring, or as a conical section made from a sheet of metal, such as copper. Common ends of the second plurality 17 of antenna elements are shaped to a second common point 16. The feeding point 15, which may include a third support such as an insulator, preferably rigidly connects the second common point 16 of the second plurality 19 of antenna elements with the first common point 14 of the first plurality 13 of antenna elements, thereby forming a rigid dipole. The broadband antenna has the second conical shape of the cylindrical antenna, at the second common point 16, opposite to the first conical shape of the cylindrical antenna, at the first common point 14.

Figure 4:
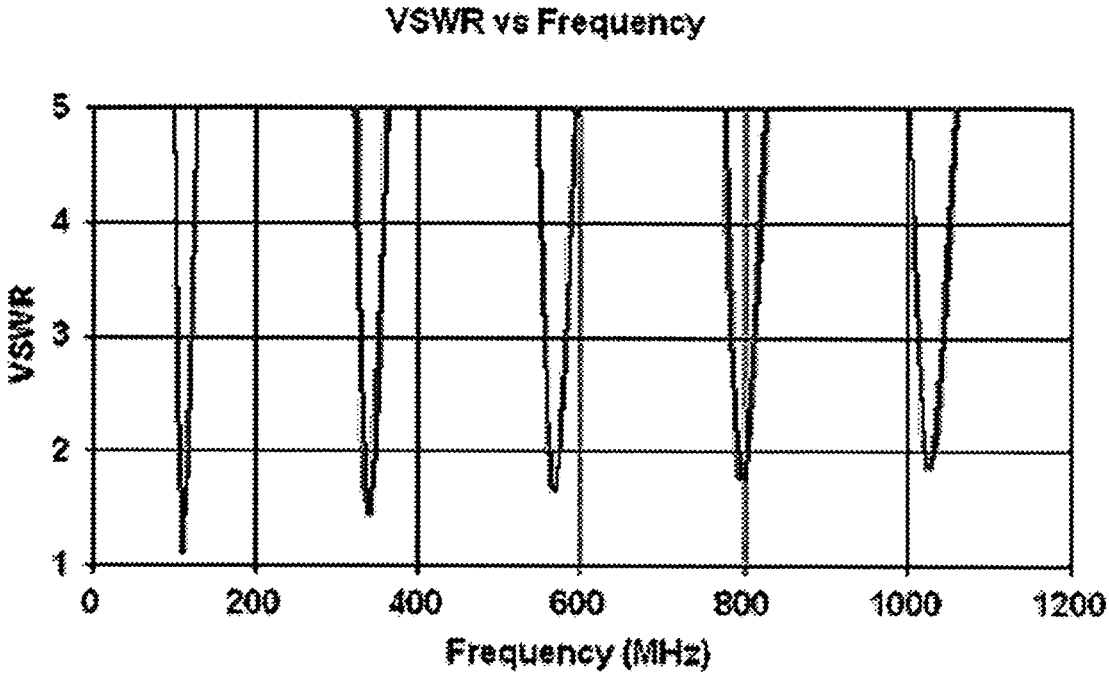
FIG. 4 illustrates VSWR of a dipole antenna.
Figure 5:
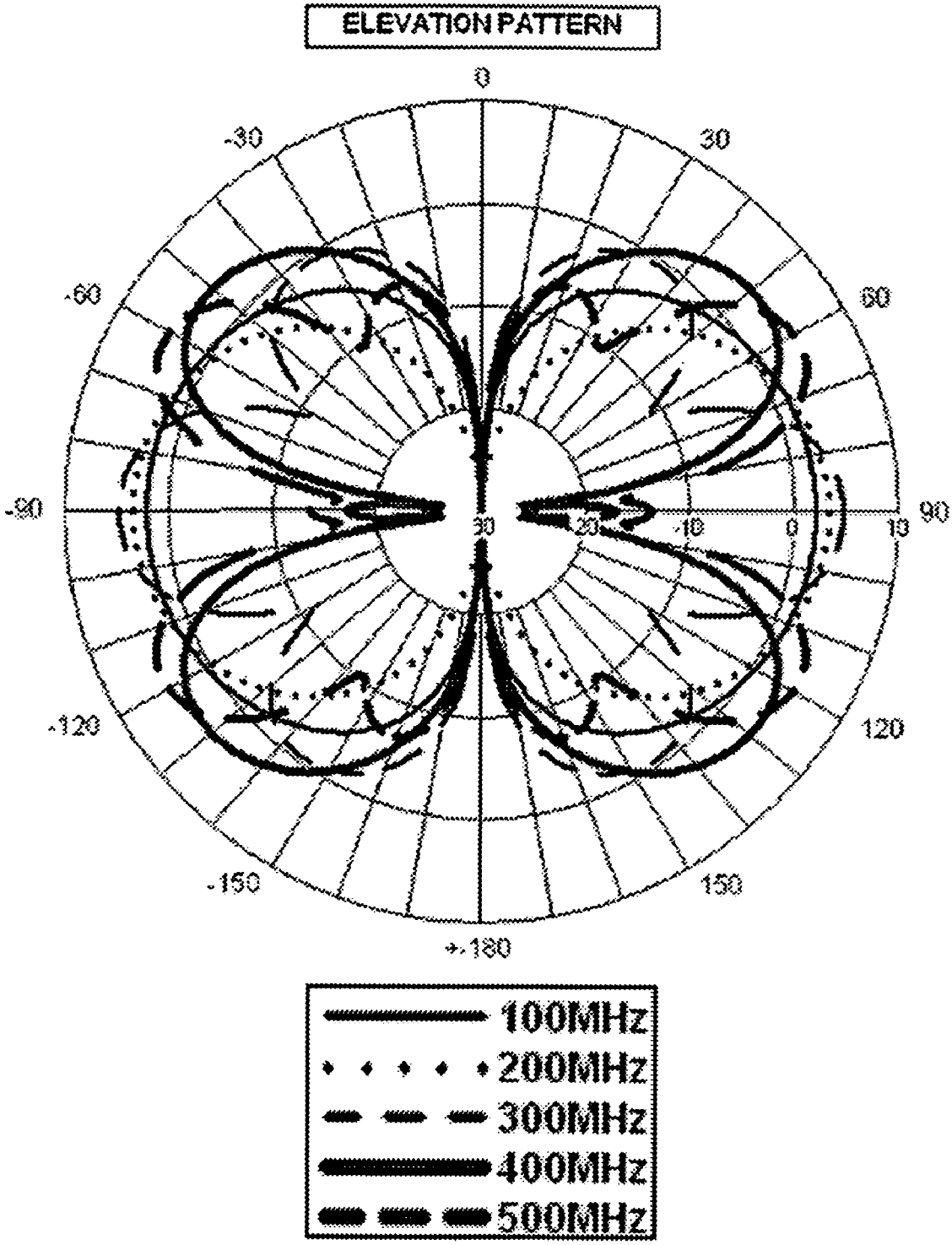
FIG. 5 shows the elevation pattern of a dipole antenna for 100 MHz, 200 MHz, 300 MHz, 400 MHz, and 500 MHz.

FIG. 4 shows the VSWR versus frequency, for a dipole antenna with length of 1.3 meters. The VSWR only is below 2.0 at select frequencies, which are related to the length f the dipole. FIG. 5 shows the antenna pattern of the dipole, at frequencies 100 MHz, 200 MHz, 300 MHz, 400 MHz and 500 MHz. Noteworthy is that the dipole of 1.3 meters length does not have a constant radiation pattern.

Figure 6:
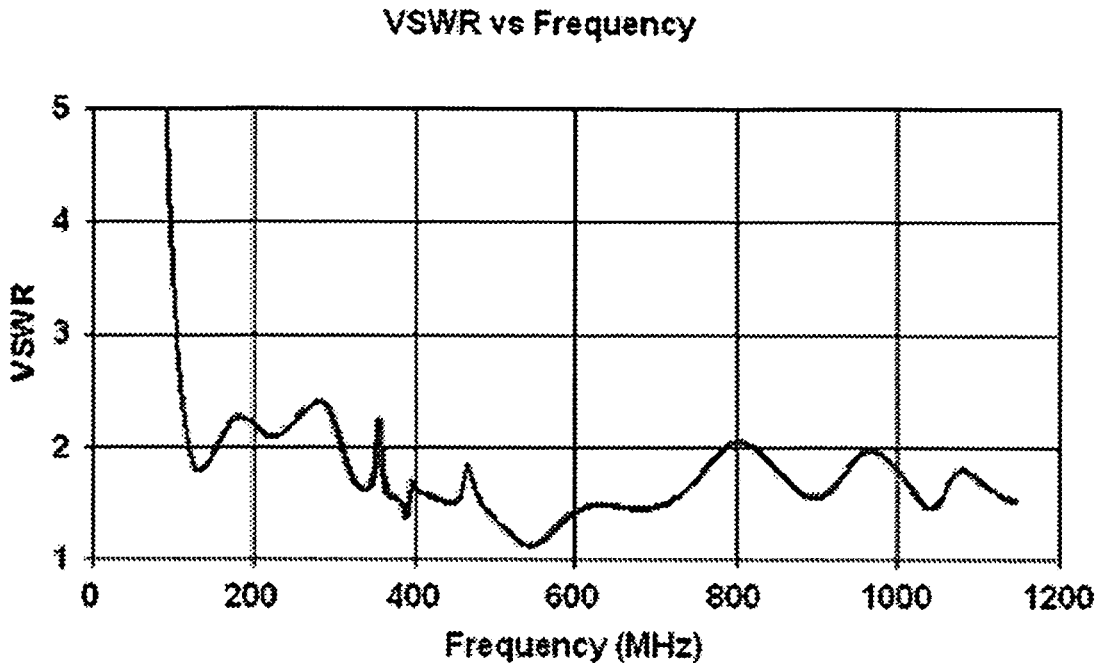
FIG. 6 illustrates VSWR of the compact broadband antenna.
Figure 7:
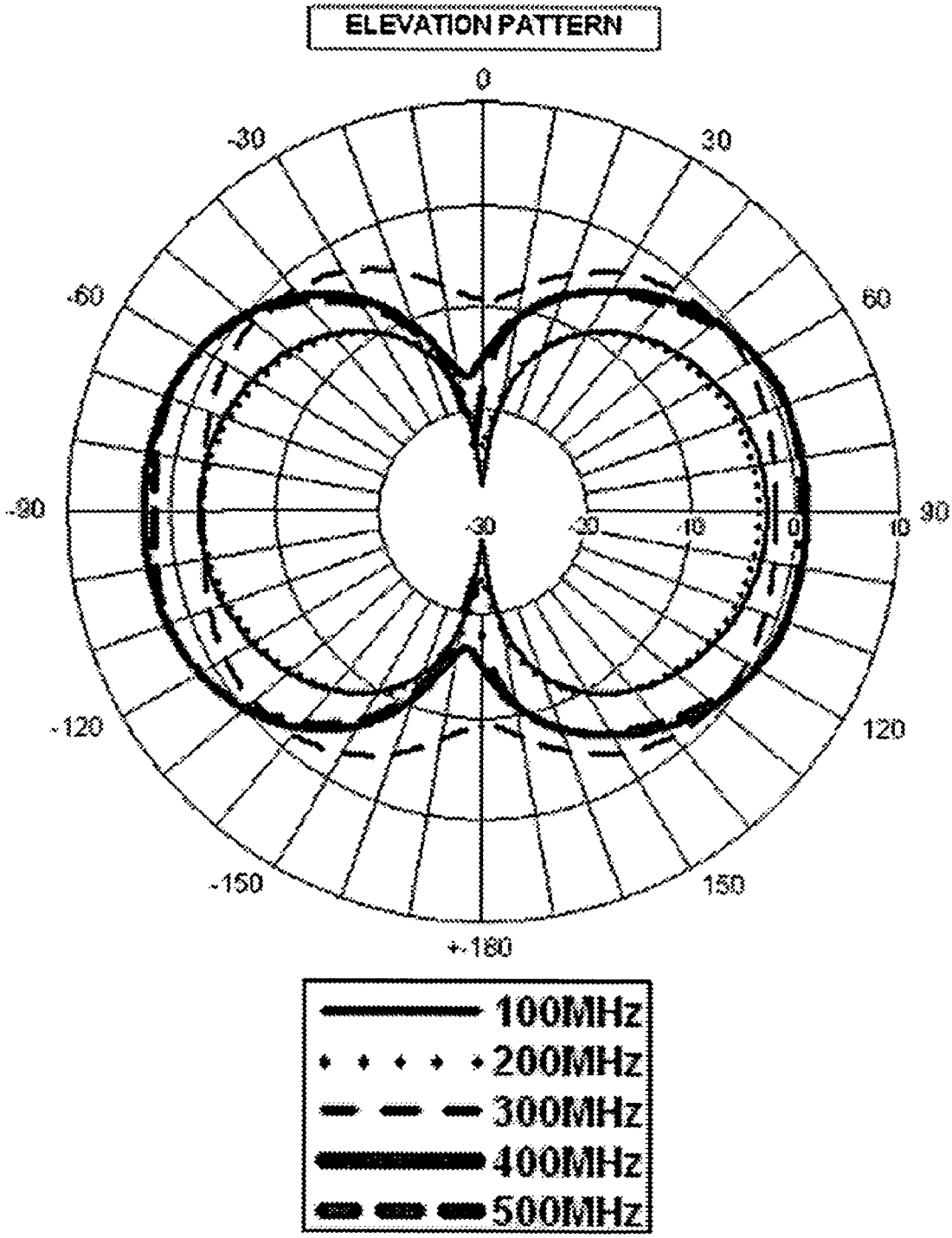
FIG. 7 shows the elevation pattern of the broadband antenna for 100 MHz, 200 MHz, 300 MHz, 400 MHz, and 500 MHz.
Figure 8:
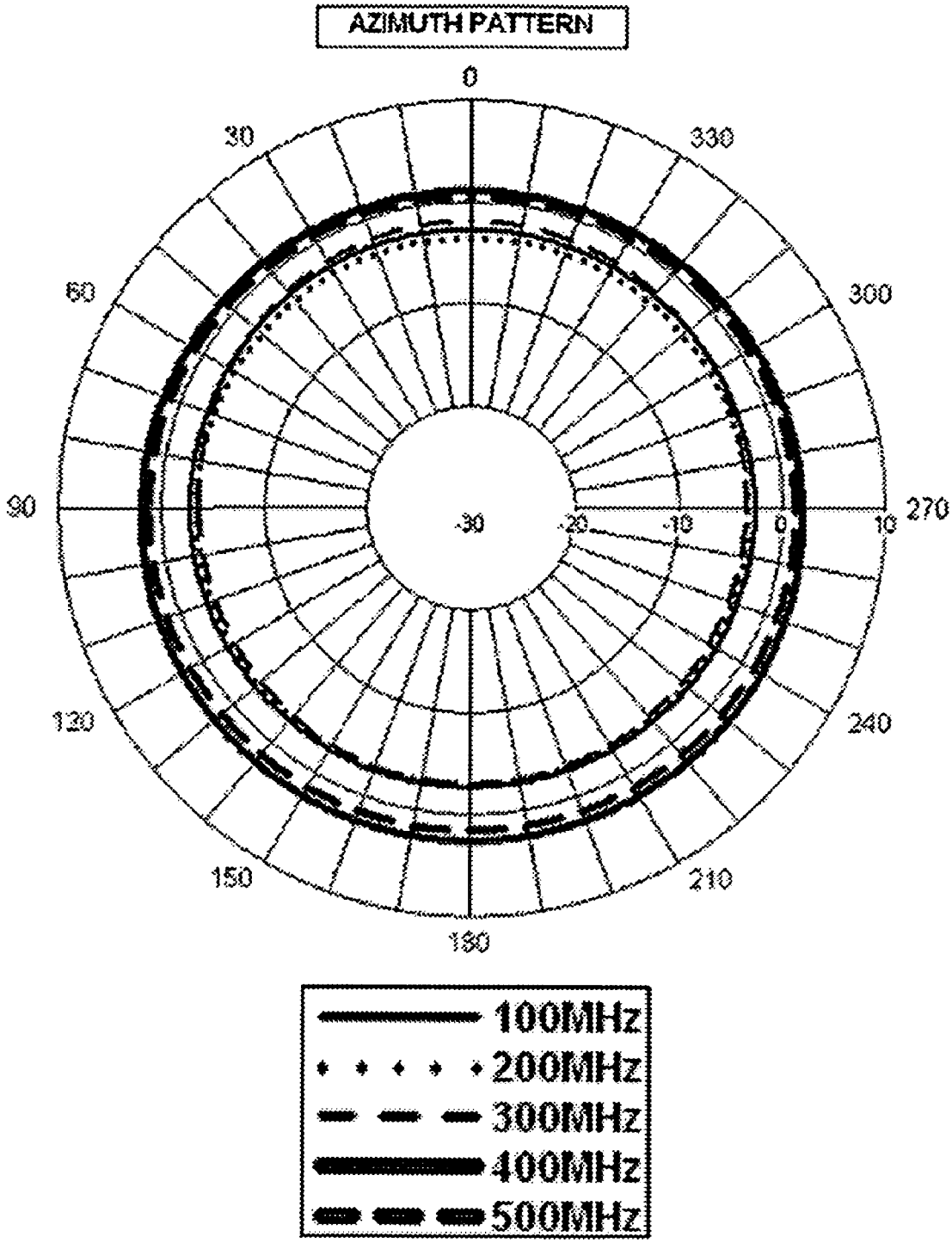
FIG. 8 shows the azimuth pattern of the broadband antenna for 100 MHz, 200 MHz, 300 MHz, 400 MHz, and 500 MHz.

FIG. 6 shows the VSWR of the present invention, broadband antenna, with overall length of 1.3 meters. The VSWR is below 2.5 for the entire frequency range of 100 MHz to over 1000 MHz. FIGS. 7 and 8 show the elevation pattern and azimuth pattern of the invented, broadband antenna with length of 1.3 meters. Note that these patterns are uniform, over the frequency range of 100 MHz to over 1000 MHz.

The present invention also includes a method of manufacture of a broadband antenna with a constant radiation pattern. The method includes comprising the steps of fabricating a first plurality of antenna elements. Each antenna element in the first plurality of antenna elements is rigid and has a different length from other antenna elements in the first plurality of antenna elements. A first longest-antenna element in the first plurality of antenna elements has a length longer than other antenna elements in the first plurality of antenna elements. The steps include fabricating a trap for inserting in the first longest-antenna element at a specific location of the longest-antenna element in the first plurality of antenna elements. Common ends of the first plurality of antenna elements are shaped to a first common point. The method connects, with a first transversal-wire ring, a common end of each antenna element of the first plurality of antenna elements. A first conical shape of the first plurality of antenna elements is firmed as a cylindrical antenna, with common ends of the first plurality of antenna elements shaped to a first common point.

The method further includes the steps of fabricating a second plurality of antenna elements. Each antenna element in the second plurality of antenna elements is rigid and has a different length from other antenna elements in the second plurality of antenna elements. A second longest-antenna element in the second plurality of antenna elements has a length longer than other antenna elements in the second plurality of antenna elements. A second trap is fabricated for inserting in the second longest-antenna element at a specific location of the second longest-antenna element in the second plurality of antenna elements. A common end of each antenna element of the second plurality of antenna elements is connected with a transversal ring. A second conical shape of the second plurality of antenna elements is formed as a cylindrical antenna, with common ends of the second plurality of antenna elements shaped to a second common point. The method connects, with an insulator, the second common point of the second plurality of antenna elements with the first common point of the first plurality of antenna elements, thereby forming a rigid dipole having the second conical shape of the cylindrical antenna, at the second common point, opposite to the first conical shape of the cylindrical antenna, at the first common point.

Variations of the Design

There are several variations of the design and each modification has specific advantages. The multi-wire antenna with end connection provides a smoother impedance variation and higher gain. The design has constant radiation pattern, improved gain, and matching characteristics. A structure using multiple wires with different A structure using bent wires to minimize the transversal dimension not sacrificing the broadband characteristics. Configurations using multiple R-L-C load/traps maintain consistent radiation patterns over a large bandwidth. Configurations using end-connection of the multiple wires with different lengths to achieve a minimal impedance variation.

The present invention utilizes multiple wires in close proximity to each other. The antenna feeds conical structures in a manner similar to feeding a 3-dimensional (3-D) antenna. The current distribution in the 3-D structure is conventional and approximates that of a conical antenna near the high frequency end of the band. For lower frequencies, the currents are progressively more and more distributed towards the longer elements. Since the wires are in close proximity to each other, they are in fact approximately a cylindrical antenna. The antenna in reality is operating somewhere between multi-element wire antenna and a cylindrical antenna, transitioning the multiband to broadband pattern. The close coupling and judicial use of filters and resistors make it truly broadband and at the same time allows optimization of the size and shape.

Because of the thin wire structure and occasional use of filters, the high frequency currents do not flow through the long wire elements. This essentially removes the pattern break-up that would appear in a pure cylindrical or conical antenna.

The compact broadband antenna is designed using electromagnetic (EM) modeling and Genetic Algorithms can be used for optimization of the elements.

It will be apparent to those skilled in the art that various modifications can be made to the compact broadband antenna of the instant invention without departing from the scope or spirit of the invention, and it is intended that the present invention cover modifications and variations of the compact broadband antenna provided they come within the scope of the appended claims and their equivalents.

We claim:

1. A broadband antenna with a constant radiation pattern, comprising:

a first plurality of antenna elements with each antenna element in the first plurality of antenna elements being rigid and having a different length from other antenna elements in the first plurality of antenna elements, with a first longest-antenna element in the first plurality of antenna element having a length longer than other antenna elements in the first plurality of antenna elements, with the first longest-antenna element having a first trap at a specific location of the first longest-antenna element in the first plurality of antenna elements, with common ends of the first plurality of antenna elements shaped to a first common point;

a first transversal-wire ring for connecting a common end of each antenna element of the first plurality of antenna elements, for forming a first conical shape of a cylindrical antenna;

a second plurality of antenna elements with each antenna element in the second plurality of antenna elements being rigid and having a different length from other antenna elements in the second plurality of antenna elements, with a second longest-antenna element in the second plurality of antenna elements having a length longer than other antenna elements in the second plurality of antenna elements, with the second longest-antenna element having a second trap at a specific location of the second longest-antenna element in the second plurality of antenna elements;

a second transversal-wire ring for connecting a common end of each antenna element of the second plurality of antenna elements, for forming a second conical shape of a cylindrical antenna, with common ends of the second plurality of antenna elements shaped to a second common point, and an insulator for rigidly connecting the second common point of the second plurality of antenna elements with the first common pont of the first plurality of antenna elements, thereby forming a rigid dipole having the second conical shape of the cylindrical antenna, at the second common point, opposite to the first conical shape of the cylindrical antenna, at the first common pont.

2. A broadband antenna with a constant radiation pattern, comprising:

a first plurality of antenna elements with each antenna element in the first plurality of antenna elements being rigid and having a different length from other antenna elements in the first plurality of antenna elements, with a first longest-antenna element in the first plurality of antenna elements having a length longer than other antenna elements in the first plurality of antenna elements, with the first longest-antenna element having a first trap at a specific location of the first longest-antenna element in the first plurality of antenna elements, with common ends of the first plurality of antenna elements shaped to a first common point;

first ring means for connecting a common end of each antenna element of the first plurality of antenna elements, for forming a first conical shape of a cylindrical antenna, with common ends of the first plurality of antenna elements shaped to a first common point;

a second plurality of antenna elements with each antenna element in the second plurality of antenna elements being rigid and having a different length from other antenna elements in the second plurality of antenna elements, with a second longest-antenna element in the second plurality of antenna elements having a length longer than other antenna elements in the second plurality of antenna elements, with the second longest-antenna element having a second trap at a specific location of the second longest-antenna element in the second plurality of antenna elements;

second ring means for connecting a common end of each antenna element of the second plurality of antenna elements, for forming a second conical shape of a cylindrical antenna, with common ends of the second plurality of antenna elements shaped to a second common point; and an insulator for rigidly connecting the second common point of the second plurality of antenna elements with the first common point of the first plurality of antenna elements, thereby forming a rigid dipole having the second conical shape of the cylindrical antenna, at the second common point, opposite to the first conical shape of the cylindrical antenna, at the first common point.

3. A method for making a broadband antenna with a constant radiation pattern, comprising the steps of:

fabricating a first plurality of antenna elements with each antenna element in the first plurality of antenna elements being rigid and having a different length from other antenna elements in the first plurality of antenna elements, with a first longest-antenna element in the first plurality of antenna elements having a length longer than other antenna elements in the first plurality of antenna elements;

fabricating a first trap for inserting in the first longest-antenna element at a specific location of the first longest-antenna element in the first plurality of antenna elements;

shaping common ends of the first plurality of antenna elements to a first common point;

connecting, with a first transversal-wire ring, a common end of each antenna element of the first plurality of antenna elements;

forming a first conical shape of the first plurality of antenna elements as a cylindrical antenna, with common ends of the first plurality of antenna elements shaped to a first common point;

fabricating a second plurality of antenna elements with each antenna element in the second plurality of antenna elements being rigid and having a different length from other antenna elements in the second plurality of antenna elements, with a second longest-antenna element in the second plurality of antenna elements having a length longer than other antenna elements in the second plurality of antenna elements;

fabricating a second trap for inserting in the second longest-antenna element at a specific location of the second longest-antenna element in the second plurality of antenna elements;

connecting, with a second transversal-wire ring, a common end of each antenna element of the second plurality of antenna elements;

forming a second conical shape of the second plurality of antenna elements as a cylindrical antenna, with common ends of the second plurality of antenna elements shaped to a second common pont; and connecting, with an insulator, the second common pont of the second plurality of antenna elements with the first common pont of the first plurality of antenna elements, thereby forming a rigid dipole having the second conical shape of the cylindrical antenna, at the second common point, opposite to the first conical shape of the cylindrical antenna, at the first common point.

4. A broadband antenna with a constant radiation pattern, comprising:

a first plurality of antenna elements with each antenna element in the first plurality of antenna elements being rigid and having a different length from other antenna elements in the first plurality of antenna elements, with a first longest-antenna element in the first plurality of antenna elements having a length longer than other antenna elements in the first plurality of antenna elements, with the first longest-antenna element having a first trap at a specific location of the first longest-antenna element in the first plurality of antenna elements, with common ends of the first plurality of antenna elements shaped to a first common point;

a first support for connecting a common end of each antenna element of the first plurality of antenna elements, for forming a first conical shape of a cylindrical antenna;

a second plurality of antenna elements with each antenna element in the second plurality of antenna element being rigid and having a different length from other antenna elements in the second plurality of antenna elements, with a second longest-antenna element in the second plurality of antenna elements having a length longer than other antenna elements in the second plurality of antenna elements, with the second longest-antenna element having a second trap at a specific location of the second longest-antenna element in the second plurality of antenna elements;

a third support for connecting the second common point of the second plurality of antenna elements with the first common point of the first plurality of antenna elements, thereby forming a dipole having the second conical shape of the cylindrical antenna, at the second common point, opposite to the first conical shape of the cylindrical antenna, at the first common point.

5. The broadband antenna as set forth in claim 4, with the first support including a first transversal-wire ring and the second support including a second transversal-wire ring.

6. The broadband antenna as set forth in claim 4, with the first support including a first conical section and with the second support including a second conical section.

7. The broadband antenna as set forth in claim 4, with the third support including an insulator.

8. A broadband antenna comprising:

a first plurality of antenna elements with each antenna element in the first plurality of antenna elements having a different length from other antenna elements in the first plurality of antenna elements, with a first longest-antenna element in the first plurality of antenna elements having a length longer than other antenna elements in the first plurality of antenna elements, with common ends of the first plurality of antenna elements shaped to a first common point;

first means for connecting a common end of each antenna element of the first plurality of antenna elements;

a second plurality of antenna elements with each antenna element in the second plurality of antenna elements having a different length from other antenna elements in the second plurality of antenna elements, with a second longest-antenna element in the second plurality of antenna elements having a length longer than other antenna elements in the second plurality of antenna elements, with common ends of the second plurality of antenna elements shaped to a second common point;

second means for connecting a common end of each antenna element of the second plurality of antenna elements; and an insulator for rigidly connecting the second common point of the second plurality of antenna elements with the first common point of the first plurality of antenna elements, thereby forming a dipole of the cylindrical antenna, at the second common point, opposite to the first conical shape of the cylindrical antenna, at the first common point;

wherein each of said first plurality of antenna elements are parallel to each other for a portion of their length prior to being shaped at said first common point, and wherein each of said second plurality of antenna elements parallel to each other for a portion of their length prior to being shaped at said second common point and further wherein the broadband antenna exhibits a constant radiation pattern over the frequency range of the broadband antenna.

9. A broadband antenna comprising:

a first plurality of antenna elements with each antenna element in the first plurality of antenna elements and having a different length from other antenna elements in the first plurality of antenna elements, with a first longest-antenna element in the first plurality of antenna elements having a length longer than other antenna element sin the first plurality of antenna elements, with common ends of the first plurality of antenna elements shaped to a first common point;

first ring means for connecting a common end of each antenna element of the first plurality of antenna elements, for forming a first conical shape of a cylindrical antenna, with common ends of the first plurality of antenna elements shaped to a first common point;

a second plurality of antenna elements with each antenna element in the second plurality of antenna elements having a different length from other antenna elements in the second plurality of antenna elements, with a second longest-antenna element in the second plurality of antenna elements having a length longer than other antenna elements in the second plurality of antenna elements;

second ring means for connecting a common end of each antenna element of the second plurality of antenna elements, for forming a second conical shape of a cylindrical antenna, with common ends of the second plurality of antenna elements shaped to a second common point; and an insulator for connecting the second common point of the second plurality of antenna elements with the first common point of the first plurality of antenna elements, thereby forming a dipole having the second conical shape of the cylindrical antenna, at the second common point, opposite to the first conical shape of the cylindrical antenna, at the first common point;

wherein each of said first plurality of antenna elements are parallel to each other for a portion of their length prior to being shaped at said first common point, and wherein each of said second plurality of antenna elements parallel to each other for a portion of their length prior to being shaped at said second common point and further wherein the broadband antenna exhibits a constant radiation pattern over the frequency range of the broadband antenna.

10. A method for making a broadband antenna, comprising the steps of:

fabricating a first plurality of antenna elements with each antenna element in the first plurality of antenna elements having a different length from other antenna elements in the first plurality of antenna elements, with a first longest-antenna element in the first plurality of antenna elements having a length longer than other antenna elements in the first plurality of antenna elements;

shaping common ends of the first plurality of antenna elements to a first common point;

connecting a common end of each antenna element of the first plurality of antenna elements;

forming a first conical shape of the first plurality of antenna elements as a cylindrical antenna, with common ends of the first plurality of antenna elements shaped to a first common point;

fabricating a second plurality of antenna elements with each antenna element in the second plurality of antenna elements having a different length from other antenna elements in the second plurality of antenna elements, with a second longest-antenna element in the second plurality of antenna elements having a length longer than other antenna elements in the second plurality of antenna elements;

connecting, with a second transversal-wire ring, a common end of each antenna element of the second plurality of antenna elements;

forming a second conical shape of the second plurality of antenna elements as a cylindrical antenna, with common ends of the second plurality of antenna elements shaped to a second common point; and connecting, with an insulator, the second common point of the second plurality of antenna elements with the first common point of the first plurality of antenna elements, thereby forming a dipole having the second conical shape of the cylindrical antenna, at the second common point, opposite to the first conical shape of the cylindrical antenna, at the first common point;

fabricating said first plurality of antenna elements in a manner providing each of said first plurality of antenna elements parallel to one another for a portion of their length prior to being shaped to said first common point; and fabricating said second plurality of antenna elements in a manner providing each of said second plurality of antenna elements parallel to one another for a portion of their length prior to being shared to said second common point;

wherein the broadband antenna exhibits a constant radiation pattern over the frequency range of the broadband antenna.

11. A broadband antenna, comprising:

a first plurality of antenna elements with each antenna element in the first plurality of antenna elements having a different length from other antenna elements in the first plurality of antenna elements, with a first longest-antenna element in the first plurality of antenna elements having a length longer than other antenna elements in the first plurality of antenna elements, with common ends of the first plurality of antenna elements shaped to a first common point;

a first support for connecting a common end of each antenna element of the first plurality of antenna elements;

a second plurality of antenna elements with each antenna element in the second plurality of antenna elements having a different length from other antenna elements in the second plurality of antenna elements, with a longest-antenna element in the second plurality of antenna elements having a length longer than other antenna elements in the second plurality of antenna elements;

a second support for connecting a common end of each antenna element of the second plurality of antenna elements, with common ends of the second plurality of antenna elements shaped to a second common point; and a third support for connecting the second common point of the second plurality of antenna elements with the first common point of the first plurality of antenna elements, thereby forming a dipole, at the second common point, opposite to the first conical shape, at the first common point;

wherein each of said first plurality of antenna elements are parallel to each other for a portion of their length prior to being shaped at said first common point, and wherein each of said second plurality of antenna elements parallel to each other for a portion of their length prior to being shaped at said second common point and further wherein the broadband antenna exhibits a constant radiation pattern over the frequency range of the broadband antenna.

12. The broadband antenna as set forth in claim 11, with the first support including a first transversal-wire ring and the second support including a second transversal-wire ring.

13. The broadband antenna as set forth in claim 11, with the first support including a first conical section and with the second support including a second conical section.

14. The broadband antenna as set forth in claim 11, with the third support including an insulator.

* * * * *